United States Patent [19]

Fink et al.

[11] 4,168,556

[45] Sep. 25, 1979

[54] ROLL AND HEAVE STABILIZED BUOYANT BODY

[76] Inventors: Charles R. Fink, 72 Berkeley St., 03060; Kenneth E. Mayo, 96 Wellington St., both of Nashua, N.H. 03060; Norman Van Dine, Old Jailhouse Rd., Amherst, N.H. 03031; John F. Holmes, 800 Dunbar Ave., Bay St. Louis, Miss. 39520

[21] Appl. No.: 824,106

[22] Filed: Aug. 12, 1977

Related U.S. Application Data

[62] Division of Ser. No. 364,847, May 29, 1973, abandoned.

[51] Int. Cl.[2] ..... B63B 21/52

[52] U.S. Cl. ..... 9/8 R; 114/264

[58] Field of Search ..... 9/8; 114/264–267, 114/270

[56] References Cited

U.S. PATENT DOCUMENTS

| | | | |
|---|---|---|---|
| 3,165,898 | 1/1965 | Elliott | 114/264 X |
| 3,349,740 | 10/1967 | Field | 114/125 X |
| 3,391,666 | 7/1968 | Schuller, Jr. | 114/265 X |
| 3,553,968 | 1/1971 | Armistead | 114/265 X |

OTHER PUBLICATIONS

John F. Holmes et al., "Tuned Drilling Platform," Jan. 1970, Ocean Industry, pp. 71, 73–75, 77.

*Primary Examiner*—Joseph F. Peters, Jr.
*Assistant Examiner*—D. W. Underwood

[57] ABSTRACT

A buoyant body stabilized against both roll and heave is described in which the hull has a generally spherical surface and in which the weight of the hull and its contents is of such magnitude and is distributed so that the body floats with a predetermined portion up and so that the natural periods of both roll and heave oscillations are greater than the periods of any waves of significant height reasonably expected to be encountered in the waters where the body is deployed. Also described is the use of the body as a self-propelled off shore oil terminal into which a super tanker can discharge its entire load while remaining in deep, traffic free water.

10 Claims, 8 Drawing Figures

ROLL AND HEAVE STABILIZED BUOYANT BODY

This application is a Division of Ser. No. 364,847, filed May 29, 1973 and now abandoned.

FIELD OF THE INVENTION

This invention relates generally to stabilized floating bodies and particularly to such bodies which are stabilized against both roll and heave motions and to the use of such bodies as deep water loading and unloading terminals.

Ocean waves acting on a floating body tend to excite it into oscillations about one or more axes at their respective natural periods of oscillation. In the case of a ship, the most prominent motion is roll. Many modern ships minimize roll by the use of surge tanks, adjustable fins, bilge keels and gyroscopes. When a ship is to be loaded or unloaded, it normally seeks out a harbor deep enough to accommodate its draft and protected enough so that the wave motions are so small that the ship can be made fast to a pier safely. When no suitable harbor is available, a large ship must heave to off-shore and transfer its load to one or more smaller ships. Such loading and unloading operations can take place only in relatively calm seas.

The problems of loading and unloading are very severe in the case of modern large oil carrying vessels, often referred to as "super tankers". Many countries, although consuming large quantities of oil, lack harbors large enough and deep enough to accommodate these super tankers directly. It has been necessary either to forego the use of such tankers to service these countries or to transfer the load to smaller ships at other ports. Even when suitable harbors are available, the operation of guiding the ship into the harbor and docking it has been a delicate, time consuming process requiring many powerful tugboats. Super tankers are so massive that even very slow speed contact between ship and dock is likely to seriously damage either or both. The situation could be greatly improved if there were an off-shore oil terminal of sufficient capacity to store the entire load of a super tanker and sufficiently stable to permit the transfer of oil during relatively rough seas.

It has been proposed in the past to make a floating body generally spherical in shape and to distribute its weight in such a way that its natural period of oscillation about a horizontal diameter is much longer than the period of any waves it is likely to encounter. Bodies of this kind have been constructed which follow the vertical and horizontal motion of waves, i.e., they surface follow, but exhibit little or no roll. Such a floating body is fully described in U.S. Pat. No. 3,487,484 granted Jan. 6, 1970 to J. F. Holmes and entitled "Tuned Floating Bodies". As explained in the patent, such a body when made in the proper size, is suitable for use as a platform for an off-shore drilling rig. A floating power plant housed in such a body is described in the copending U.S. Patent Application of Douglas C. Harvey and John F. Holmes, Ser. No. 146,393, filed May 24, 1971 and entitled "Floating Power Plant" which application is assigned to the same assignee as is the instant application.

In addition to stability against roll, as described in the above cited patent and patent application, stability against the wave-caused rhythmic up and down motion of the floating body, referred to for convenience herein simply as "Heave", is very important. In the case of platform mounted drilling rigs, heave stabilization reduces the range of relative vertical motion between the drill string and the platform which must otherwise be provided for. In the case of floating power plants, such stabilization reduces the load on bearings and other parts of the machinery. In both cases, the dynamic forces on the moorings are greatly reduced. Heave stabilization is even more important in the case of bulk cargo terminals which must maneuver themselves and their load transferring equipment in heavy seas without danger to themselves and the vessels being serviced. In all cases, heave stabilization increases the comfort of the crew. One form of heave stability has been achieved in the oceanographic ship "FLIP", sometimes referred to as "the ship that stands on its stern". "FLIP" is a long slender ship and when in use, is not unlike a long rod disposed vertically in the water. It exhibits stability against heave, but is not tuned for stability against roll and does not have sufficient volumetric efficiency for commercial purposes.

It is the general object of the present invention to provide a floating body which exhibits very little motion in either roll or heave as a result of any waves likely to be encountered in the waters in which it is designed to be deployed.

Another object is to provide a volumetrically efficient stable body suitable for deployment in deep waters for use as an oil terminal for super tankers.

SUMMARY OF THE INVENTION

Briefly stated, a structure incorporating the present invention includes a buoyant body having a generally spherical surface. The weight of the body and of the equipment installed thereon is of such magnitude and so distributed as to provide a righting movement so that the body tends to float with a predetermined portion up and so as to make the natural period of oscillation about any horizontal axis (roll) and also the natural period of oscillation up and down (heave) greater than the period of any waves of significant height reasonably expected to be encountered where the body is to be deployed. The availability of such a body is the key to the off-shore loading and unloading problem and enables the use of a procedure by which a large ship may be anchored in deep water and be unloaded into a self-propelled body which is maneuvered into unloading position with minimum danger of collision.

BRIEF DESCRIPTION OF THE DRAWING

For a clearer understanding of the invention reference may be made to the following detailed description and the accompanying drawing in which.

Figure 1:
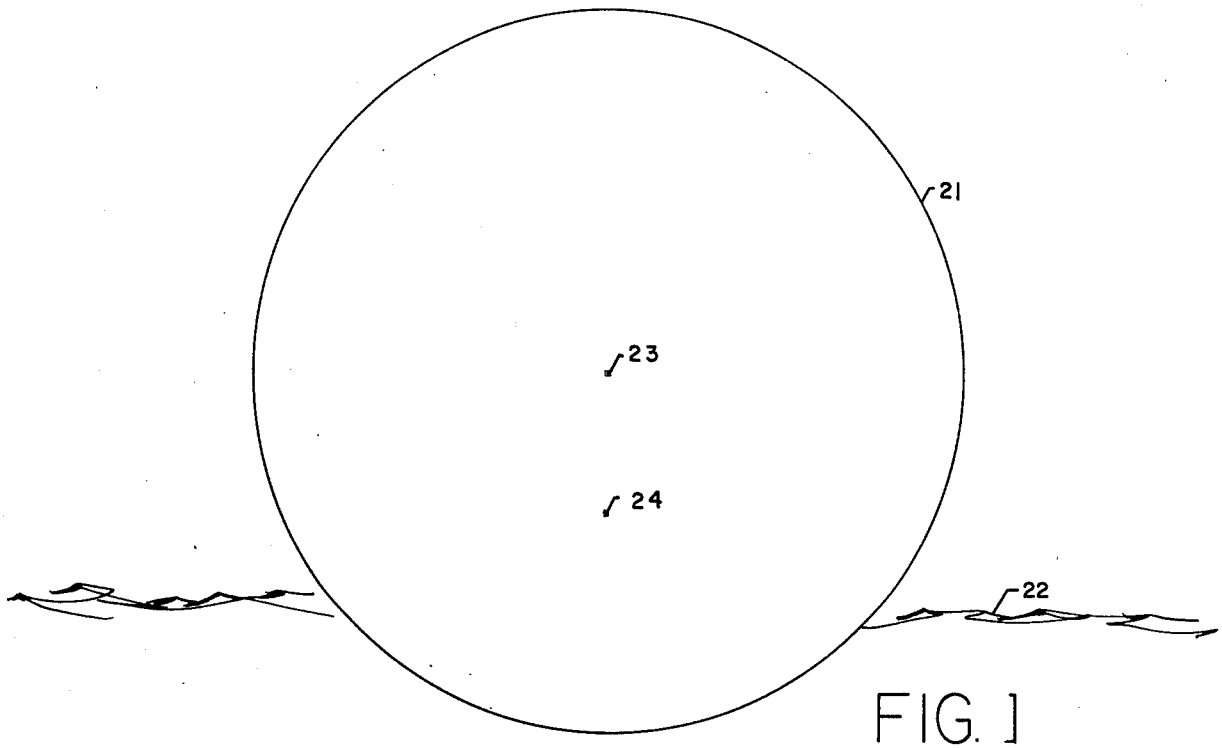
FIG. 1 is a schematic diagram of a buoyant spherical body.

Referring first to FIG. 1 there is shown a spherical body 21 floating on the surface 22 of the water. If the sphere is perfectly balanced, as by having its weight uniformly distributed on its surface, the sphere is free to roll while floating and has no tendency to assume any particular orientation. The sphere has the feature unique among all buoyancy shapes of rotating about its center 23, regardless of the location of the water line. The sphere is also unique in that all hydrostatic forces (neglecting skin friction) are applied perpendicular to its surface, and therefore must necessarily pass through its center. If the sphere is unbalanced, so that its center of gravity is at some point 24 displaced from the center 23, it will, of course, tend to float with the center of gravity directly beneath the geometric center, as shown, but when excited, will oscillate about its center 23 as a pendulum at its natural period of oscillation. The period of such oscillation is given by the expression $$Tr=2\pi\sqrt{I/K_1} \qquad \text{Eq. (1)}$$

where

Tr=period of roll about the center,

I=moment of inertia about a horizontal diameter;

$K_1$=roll stiffness, or Wh, where

W=total weight; and h=vertical distance from center of sphere to center of gravity.

As explained more fully in the aforementioned patent, the roll of a floating spherical body can be minimized, in fact, substantially eliminated by "tuning" the sphere, that is, by suitably distributing its weight, so that the natural period of roll as determined by equation (1) above, is greater than the period of any waves of significant height reasonably expected to be encountered in the waters where the body is deployed.

A spherical floating body designed and constructed in accordance with the above principles, although exhibiting little or no roll, will, in general, "heave", that is, oscillate up and down, unless further design criteria are adhered to. Such up and down motion is to be expected because, as the crest of a wave engages the body, the water line tends to rise thereby increasing the displacement and the resulting buoyant force. The body thus tends to rise with the wave. Similarly, upon the arrival of the trough of the wave, the water line tends to fall thereby decreasing the displacement and the resulting buoyant force whereupon the weight of the body tends to cause the body to descend. In effect, unless designed to do otherwise, the body tends to be a water surface follower. It can be shown by straightforward analysis that the natural period of vertical oscillation (heave) in response to water surface motion is given by the expression $$T_h=2\pi\sqrt{W/gK_2} \qquad \text{Eq (2)}$$

where $T_h$=period of heave;

W=total weight;

g=gravitational constant; and $K_2$=change in buoyancy per foot of change in water line.

By using equation 2, it is possible to design and construct a floating spherical body having a natural period of heave which is greater than the period of any waves of significant height reasonably expected to be encountered in the waters where the body is to be deployed. By such design, waves having a shorter period do not significantly excite oscillation.

It is to be noted that the criteria of equations (1) and (2) are compatible, that is, it is possible to design a spherical floating body in accordance with the principles of both equation (1) and equation (2). The period of roll may be varied by varying the weight distribution while the period of heave may be varied by varying the total weight and/or the change in displacement with changes in the height of the water line.

It is also to be noted that it is not essential that the surface of the body be perfectly spherical but that it is sufficient if it be generally spherical. The expression "a generally spherical surface" is meant to include not only surfaces which are completely and truly spherical but also to include surfaces which may depart from the truly spherical by random minor irregularities and/or by having their surfaces formed in whole or in part by nonspherical portions, curved or flat, such as portions of paraboloids and/or flat panels in the form of triangles, hexagons or other polygons, and/or by being incompletely spherical to the extent that a minor portion thereof, such as a minor zone of one base, may be absent and may or may not be replaced and/or supplemented by another surface such as a plane or a cone or a different curved surface, provided that the major portion of the surface, or at least the major portion of the normally submerged portion thereof, approximates a spherical surface sufficiently closely so that the lines of action of the great majority of the hydrostatic forces acting thereon pass through a volume surrounding the geometric center thereof which volume is small compared to the total volume enclosed by the surface.

Figure 2:
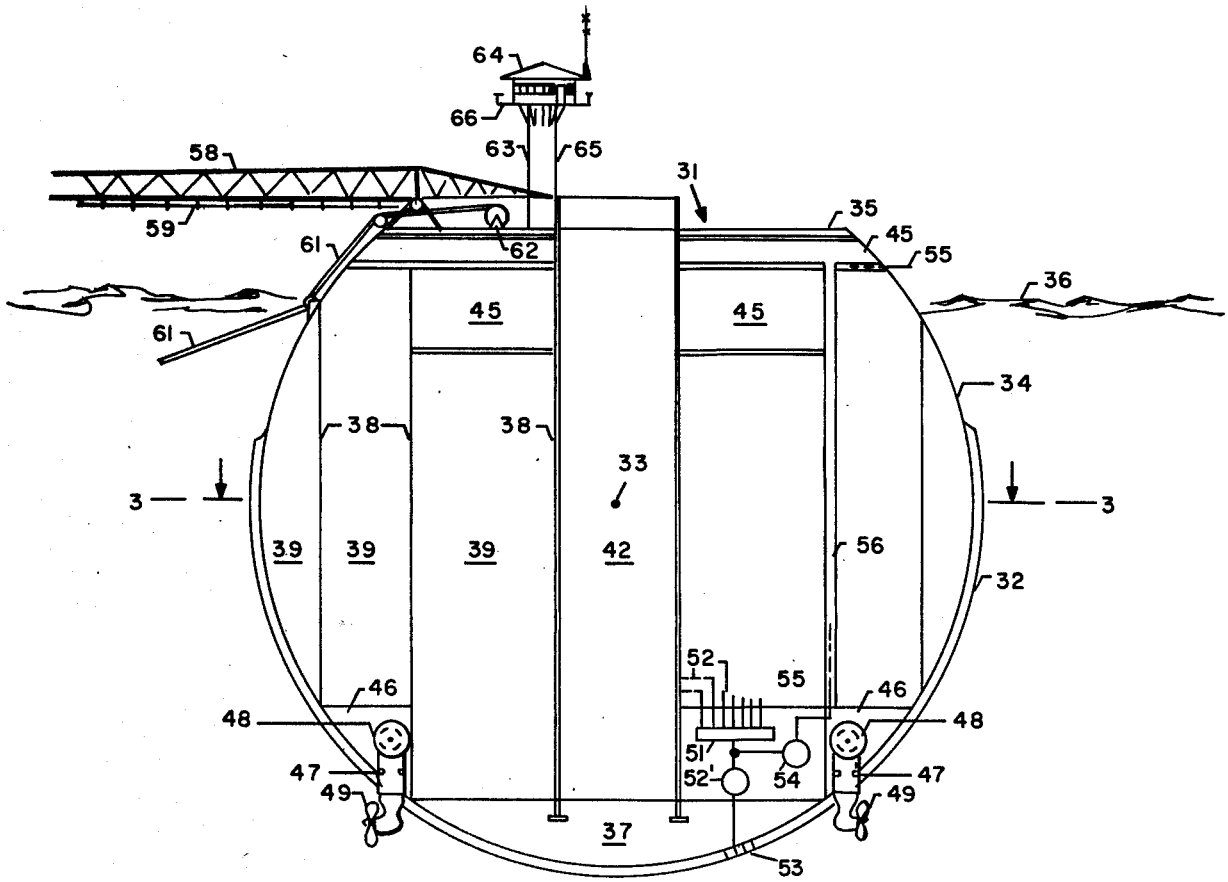
FIG. 2 is a schematic cross section view of a body incorporating the invention which is useful as an off-shore oil terminal.

Referring now to FIG. 2 there is shown schematically a buoyant body suitable for use as a terminal for bulk cargo, especially oil. The body has a generally spherical surface. More particularly, the surface has the general shape of a major spherical zone of one base. (As is well known, a spherical zone is a portion of the surface of a sphere included between two parallel planes. The circumferences of the circles which bound the zone are called the bases and the perpendicular distance between their planes, the altitude. A zone of one base is a zone one of whose bounding planes is tangent to the sphere.) The terminal as a whole is indicated generally by the reference character 31 and includes a hull the lower portion 32 of which, in large embodiments, is preferably made of prestressed concrete. The portion 32 preferably extends from the bottom upward to a point above the center 33 of the sphere. The remaining portion 34 of the hull is preferably of metal such as steel or aluminum, and extends from the lower concrete portion 32 upward to the deck 35, the latter lying in the plane of the single base of the zone. The normal water line 36 intersects the body on the hull portion 34, well below the deck 35.

Figure 3:
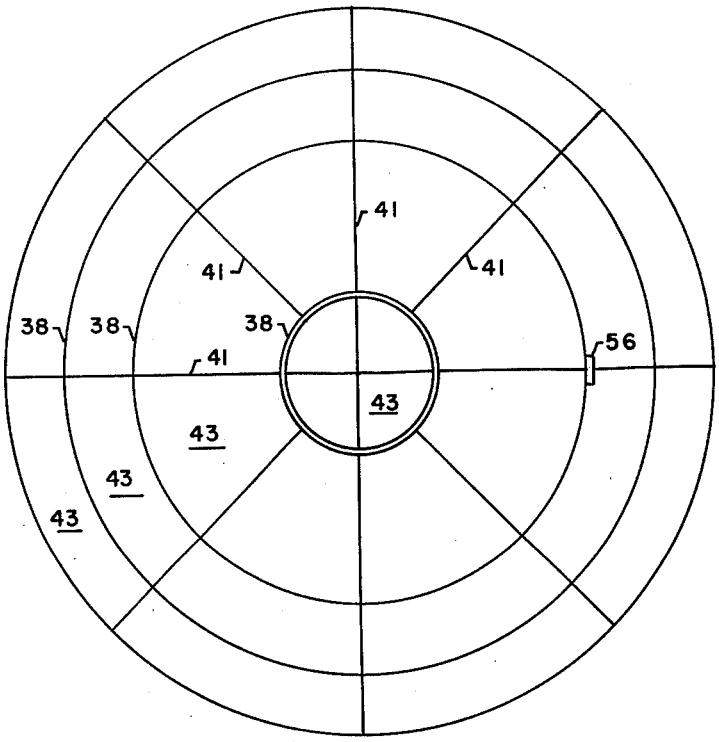
FIG. 3 is a schematic cross section view taken on the line 3—3 of FIG. 2.

The very bottom of the interior of the sphere is preferably filled with permanent ballast 37 such as concrete so as to give the body a suitable righting moment so that it will float with the deck 35 above the water line and horizontal. The interior of the body is preferably divided by a plurality of generally cylindrical vertical partitions 38 thereby dividing the interior into a number of annular spaces 39. As shown in FIG. 3, there are preferably also a number of radial partitions 41 which further divide the annular spaces, as well as a central cylindrical space 42, into a number of bulk cargo storage compartments 43. In the present embodiment these compartments 43 are oil storage tanks. The upper part of the body is preferably divided into a number of operating areas 45 including quarters for the crew, space for power generating equipment, space for the control gear, space for pumps, and all the other various areas necessary for the maintenance and operation of a seagoing vessel having the function of an oil storage and transfer terminal.

Near the bottom of the interior of the body is a generally annular space designated as a drive tunnel 46. Mounted through the hull are a plurality of thrusters 47 each driven by an electric motor 48 and each of which is rotatable about a vertical axis so that the propellers 49 can be made to exert thrust in any direction with the result that the body 31 can be propelled equally well in any direction by suitably adjusting the thrusters.

Also positioned within the drive tunnel 46 is a manifold 51 to which are connected pipes 52 one of which leads to each of the oil tanks 43. The manifold 51 is also in communication with a shut off valve, or seacock 52', which in turn communicates, through appropriate screens 53, with the outside of the hull 32. The manifold 51 also communicates with the inlet side of a pump 54 the outlet side of which communicates with a pipe 55 which leads upward and through the hull portion 34 to the outside of the terminal at a point above the water line. This arrangement enables water ballast to be expelled from each tank as it is being filled with oil and to be admitted as each tank is emptied of oil. The pipe 55 may conveniently be run through an access shaft 56 which extends upward from the drive tunnel 46 to the operating area 45 and which may also contain an elevator, power lines an other necessary equipment.

A long lightweight boom 58 is mounted on the deck 35 and extends approximately horizontally beyond the edge of the terminal 31 over the water. The boom 31 supports a length of buoyant, flexible hose 59 which is used to transfer oil to and from the terminal 31. A hawser 61 is shown passing over a number of pulleys and may be reeled in or payed out by means of a winch 62. A super structure 63 includes a pilot house 64 including a deck 66 mounted on a hollow column 65, preferably generally cylindrical and high enough above the deck 35 so that the pilot has an unobstructed view in all directions.

OPERATION

After travelling from a foreign oil field half-way around the world, the super tanker, loaded with as much as 4,000,000 barrels of crude oil, arrives in the neighborhood of a preselected rendezvous point, heads into the wind, reverses its engines, and eventually comes to a stop. The tanker then drops a line to the bottom to establish its status as an anchored ship. This status is radioed to the master of the terminal 31 which should be within a mile or two of the tanker at this time. Upon receipt of the message and its acknowledgment, the terminal 31 can start to move toward the tanker.

Figure 4:
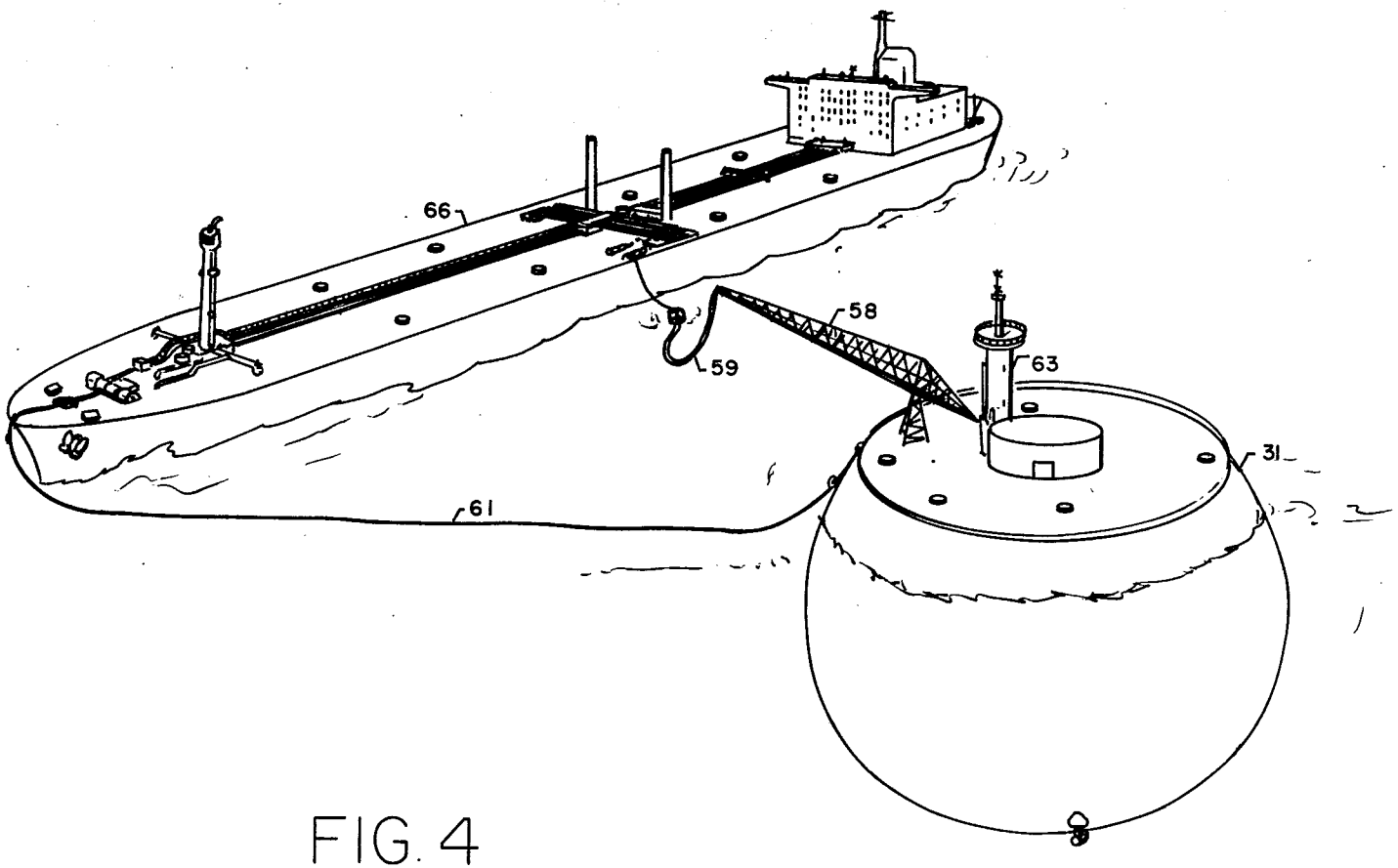
FIG. 4 is a pictorial view showing the terminal establishing oil transferring connections with a super tanker.

As depicted in FIG. 4, the terminal 31 uses its thrusters and moves within a few hundred feet of the tanker 66. Rotating slowly, the terminal moves so that its long, lightweight boom is carried near to the tanker's pumping manifold. Both vessels are very massive. However, since the terminal 31 can accelerate in any direction much faster than the tanker 66 can move sideways, the terminal can be controlled to hold a proper and predetermined relative position with respect to the tanker. In this position, a messenger line is fired from the terminal to the crew of the tanker. This line enables the tanker crew to haul in both a towing hawser 61 and the large floating crude oil transfer house 59. The hose is made fast amidships on the tanker and the hawser bight is hauled to the bow of the tanker and made fast there. At this time, the terminal 31 moves upwind, swinging its boom slowly away from the tanker as it pays out the hose.

Figure 5:
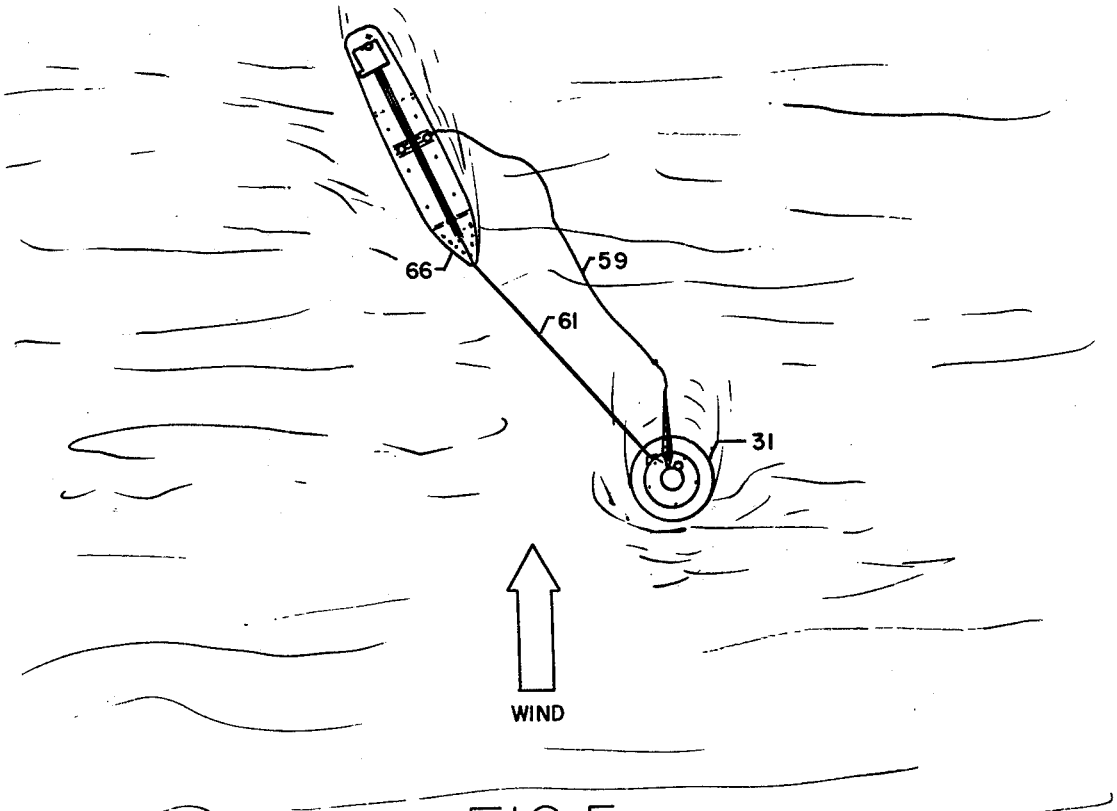
FIG. 5 is a schematic diagram showing the relative positions of the terminal and the tanker as oil is being transferred.

As the terminal 31 moves upwind, the hawser becomes taut. As best shown in FIG. 5, the terminal thrusters are set to provide just enough towing load to keep the two massive vessels at an angle with the resultant of the wind and the sea forces so that in any emergency (towing power lost, hawser break, etc.) the vessels are carried apart rather than into collision. This position is maintained for as long as necessary for the tanker to pump its entire load (500,000 tons or so) of crude oil into the tanks of the terminal 31. As pumping proceeds, the manifold 51 and pump 54 are operated to expel the sea water ballast from each tank 43 as it is filled with oil.

Upon completion of oil transfer, a plug of water is pumped through the hose line to prevent oil spillage upon disconnection from the tanker. The tanker then casts off the hose connection and starts her engines. The terminal reels in the hose and moves out of the tanker's way. When the hawser is slack, it is cast off by the tanker and reeled in by the terminal.

To complete its job, the terminal 31 may now move to a rendezvous with one or more shallow draft coastal tankers to which it transfers its cargo. These small tankers in turn transport the oil directly to tide water refineries. Alternatively, the terminal may move to a deep water single buoy moor, sometimes referred to as SBM, from which permanent plumbing runs to shore. The terminal may then discharge its crude oil via the SBM to storage facilities and refineries ashore. At some sacrifice in storage capacity, the terminal may be equipped with pumps of sufficient capacity to deliver 10,000 to 40,000 tons per hour of crude oil for distances of 25 miles or so. Super tankers do not, in general, have such pumping capacity and if they are to unload via such a moor, they must either rendezvous with a moor close to shore or remain at the distant moor an inordinately long time while unloading at a greatly reduced rate.

ILLUSTRATIVE EXAMPLE

A stabilized buoyant body suitable for use as an oil terminal as above described may have the following parameters.

| | |
|---|---|
| Diameter | 340 feet |
| Draft | 270 feet |
| Height of deck above water | 35 feet |
| Total Displacement | 587,000 tons |
| Metacentric height | 16 feet |
| $T_h$ | 20 seconds |
| $T_r$ | 30 seconds |

The calculations for the metacentric height and the heave and roll periods are straightforward. A diameter and a draft are selected and calculations carried out to see if these dimensions give satisfactory displacement.

In the above case, it is a simple matter to calculate the total displacement from the given dimensions and it comes out to be approximately 587,000 tons. To compute the heave portion it is necessary to compute $K_2$ of Equation (2), the change in buoyancy per foot of change of water line. This is simply the weight of a column of water one foot deep having the area of the horizontal circular cross section of the sphere at the water line. Calculation of this value is straightforward and $K_2$ turns out to be approximately 1,840 tons per foot. Substituting the above values into equation (2) shows that the heave period is about 20 seconds.

Calculation of the roll period is also quite simple. First it is necessary to calculate the moment of inertia about a horizontal diameter. It is assumed that we are dealing with an entire sphere and that its weight is uniformly distributed. Making this simplifying assumption, the moment of inertia is equal to 2/5 $Mr^2$ where M is equal to W/g and r is the radius of the sphere. Using the previously given values, the moment of inertia comes out to be 212,500,000 ton-ft-sec$^2$. It is next necessary to know the value of $K_1$, the roll stiffness which is equal to $W \times h$. More useful perhaps would be to know the metacentric height h. It is convenient to rewrite equation (1) as follows:

$$T_r = 2\pi\sqrt{I/Wh} \qquad \text{Eq. (3)}$$

A good value for $T_r$ is 30 seconds and this value, along with the values given above for I and W, are put into equation 3 which is then solved for the metacentric height, h. Calculation shows this to be about 16 feet. This means, of course, that the elements of system mass must be so distributed as to make the center of gravity of the body lie 16 feet below the center of the sphere. This can be accomplished without appreciably changing the previously calculated value for the moment of inertia or, alternatively, the new moment of inertia can be calculated based upon the new conditions. It is to be noted that in this example it was not necessary to resort to an elevated weight, as illustrated in the aforesaid patent, in order to obtain a suitable roll period.

A stabilized buoyant body in accordance with the invention is useful for many purposes besides an oil terminal. For example, it is also suitable for use as a Liquified Natural Gas (LNG) terminal. Additionally, as previously suggested, the invention is useful in connection with platform mounted drilling rigs and in connection with floating power plants. A body suitable for the latter purpose is denoted generally by the reference character 71 in FIG. 6. As in the case of the oil terminal, the hull preferably comprises a lower section 72 made of prestressed concrete and an upper section 73 made of metal. A small flat deck 74 is provided at the top of the body and a pilot house 75 is mounted above the deck on a hollow cylindrical column 75'. The interior of the body is divided by a generally right cylindrical wall 76 which forms a cylindrical space at the center and an annular space all around the outside. This outside space is preferably utilized for collision barriers and as such may be in communication with the outside sea water through a plurality of restriction orifices and may also contain a heat exchanger 77. A reactor pressure vessel 78 is preferably located at the very bottom of the body and is enclosed on all sides by a sturdy containment wall 79. The turbines and generators, indicated generally by the reference character 81, may be mounted on the wall 79 directly above the pressure vessel 78. Above the turbines and generators, the remaining cylindrical space is taken up with switch gear, machine shops, control rooms and living quarters. Of course, alternate arrangements of equipment may be employed, but is is desirable to install the reactor pressure vessel and the steam generators as far as possible below the waterline so as to best utilize the surrounding sea for safety enhancement, i.e., to reduce the hazard of release of reactor materials in case of accident and to reduce the likelihood of such accidents, also to place the reactor and its containment vessel well below the force vector of potentially colliding surface vessels.

An example of a suitable stabilized body for housing a power plant is as follows:

| | |
|---|---|
| Diameter | 340 feet |
| Draft | 315 feet |
| Height of deck above water | 15 feet |
| Total Displacement | 604,000 tons |
| Metacentric Height | 17 feet |
| $T_h$ | 31 seconds |
| $T_r$ | 30 seconds |

Calculations of the metacentric height, heave and roll periods, are made for this example just as they were in the case of the other example. Although in both examples the diameter is 340 feet, it is to be noted that in the case of the power plant the height of the deck above the water was selected to be less. This results in a longer heave period and is made possible because it is not usually necessary to guard against waves breaking over the deck in the case of the power plant because there is little or no machinery on the deck and no personnel are required there during normal operation. In the case of the oil terminal, it is preferred to select a greater deck height even if it means slightly smaller heave period because there is considerable machinery on the deck and the presence of the crew there is necessary during operations. It is to be noted that for any given size of body shaped as shown in FIGS. 2 and 6 with the working deck in the plane of the single base, there is a trade off among the size of the deck, its height above the normal water line, and the natural period of heave.

Figure 6:
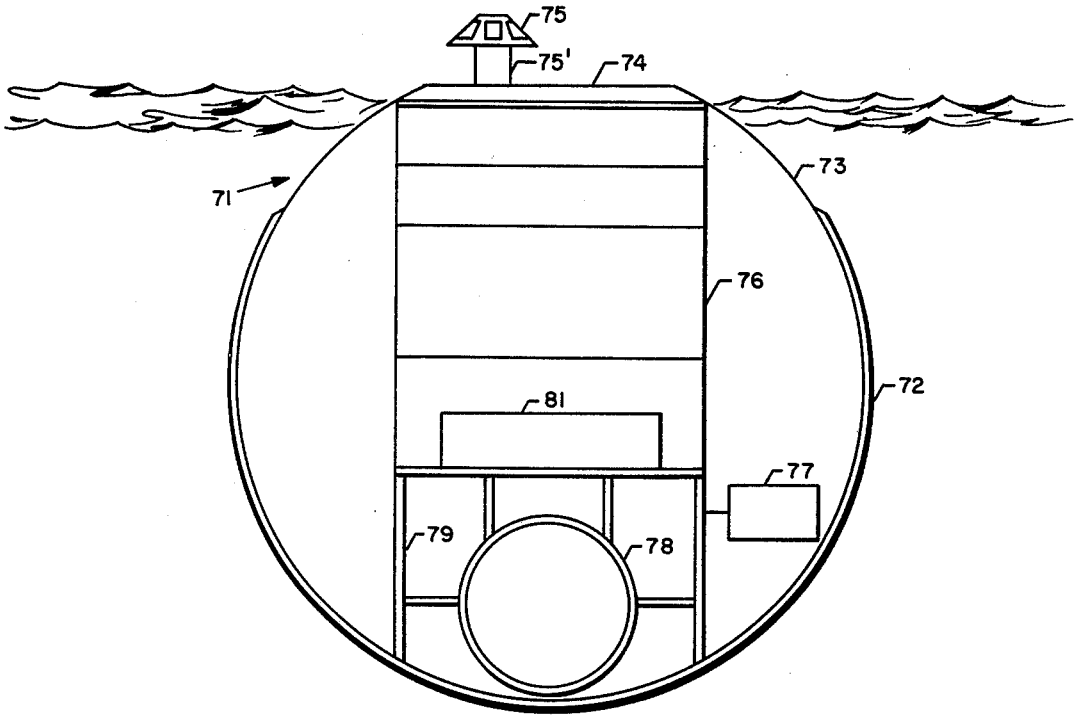
FIG. 6 is a schematic diagram showing the use of the invention in connection with a floating power plant.

If a buoyant body is required to have both a long heave period and a work area above the crests of the highest waves, it may be achieved simply by constructing a working deck on suitable supports above the level of the deck 74 of FIG. 6. Alternatively, the shape of the upper part of the body may be modified, as shown, for example, in FIG. 7. In this Figure, the lower portion of the body 91 is, as before, in the shape of a spherical zone of one base. However, instead of a flat deck in the plane of the single base, the body is continued upward in the form of a frustrum of a right circular cone 92 whose elements 93, 93 are tangent to the spherical surface and the lower base 94 of the cone coincides with the lower base of the spherical zone. The upper base 95 of the cone is also the lower base of a hollow, generally cylindrical column 96 which extends upward as far as necessary to place its top above the crests of the highest waves. On top of the column 96 is a working deck 97. The column 96 is large enough in cross section to include an interior passageway such as a hoist way 98 of sufficient size to allow the passage between the interior of the body 91 and the top of the deck 97 of the largest piece of equipment which it might be necessary to remove or replace for maintenance at sea. A penthouse 99 is mounted above the deck 97 and preferably houses hoisting machinery, a portion of which is shown schematically by the reference character 100.

The superstructure above the zonal base 94 is quite light in weight compared with the rest of the body 91 with the result that the heave and roll characteristics do not differ greatly from those of the bodies previously described. The body 91 may be designed in accordance with the previously explained principles. If the various parameters are selected to be substantially the same as those selected for the body 71 of FIG. 6, then the normal water line will be at or near the base 94. However, it is advantageous to select the weight, by adding ballast, if necessary, to place the water line well up on the conical surface 92 or even on the column 96, above the base 95, as shown at 102. Such design results in a large natural period of heave because the cross section area at the water line is small with the result that the buoyance changes but little as the crests and troughs of the waves raise and lower the water line.

Figure 7:
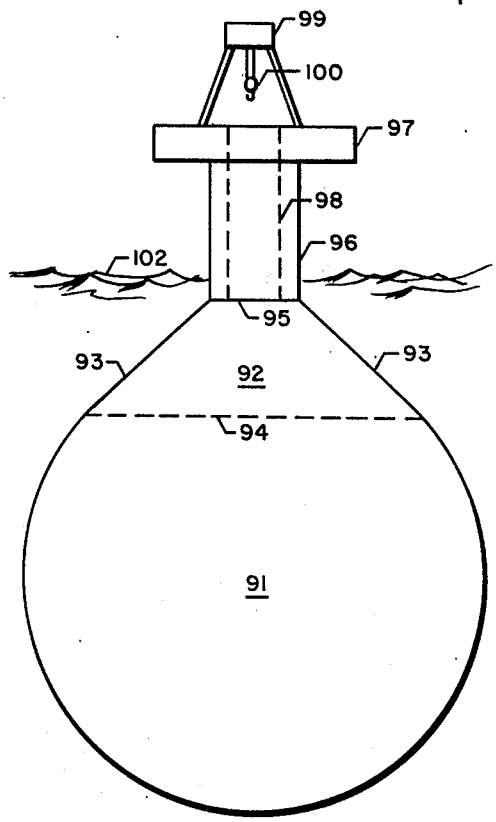
FIG. 7 is a schematic elevation view of another buoyant body in accordance with the invention.
Figure 8:
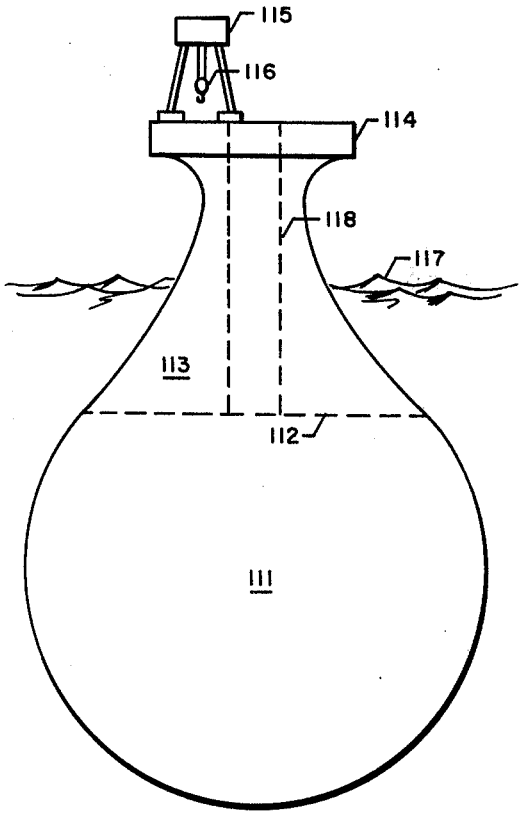
FIG. 8 is a schematic elevation view of yet another buoyant body in accordance with the invention.

FIG. 8 shows a buoyant body 111 similar to the body 91 of FIG. 7 in that the lower portion is a spherical zone of one base, the location of which is indicated by the dotted line 112. The principal difference is that the superstructure extends above the base 112 in a smooth, continuous curve 113, tangent to the spherical surface at the base 112 and extending upward to approximately the same height as the column 96 of FIG. 7 at which point it supports a working deck 114. Mounted above the deck 114 is a penthouse 115 housing hoisting machinery, a portion of which is shown schematically at 116. The body 111 is preferably designed to place the normal water line 117 somewhere along the superstructure 113 so as to obtain a long natural heave period due to the small cross sectional area at the water line. As previously mentioned, the superstructure 113 is hollow and should include a passageway 118 to allow equipment to be transferred between the interior of the body and the top of the deck 114.

Although specific examples of the invention have been described in considerable detail for illustrative purposes, many modifications will occur to those skilled in the art. It is therefore desired that the protection afforded by Letters Patent be limited only by the true scope of the appended claims.

What is claimed is:

1. A buoyant body provided in the shape of a major spherical zone of one base and in which said weight is distributed so as to make said body tend to float with said base up and with the center of gravity displaced along an axis perpendicular to the base from the spherical center toward the intended bottom of the body so as to provide a righting moment making the body tend to float with a diametric plane parallel to said one base and generally parallel to the water line, and with the water line intersecting the spherical surface in a plane parallel thereto so that a predetermined portion lies above the water line and a horizontal plane of said sphere passing through the center of gravity lies beneath the water level, said body being also formed to include a generally frusto-conical structure tangent to said zone at said base and a generally cylindrical surface extending upward from said frusto-conical portion, said body, said frusto-conical structure and said cylindrical surface being formed so that the center of gravity, the righting moment and the stability of heave and roll remain undisturbed, said spherical body and the contents contained therein being inherently arranged so that said body is stable against both roll and heave by providing the natural period of its oscillation about any horizontal diameter within the intersecting plane and the natural period of vertical oscillation along a diametric axis perpendicular to the horizontal plane are simultaneously both greater than the period of any waves of significant height reasonably expected to be encountered by the body thereby maintaining said base in generally stable horizontal position.

2. A buoyant body in accordance with claim 1 in which the weight of the body is selected in accordance with the following relation to obtain a body with the desired natural period of vertical oscillation:

$$Th=2\pi\sqrt{W/gK_2}$$

where

Th equals the natural period of vertical oscillation (heave);

W equals the total displacement of the body;

g equals the gravitational constant; and $K_2$ equals the change in buoyancy per unit of change in the water line.

3. A buoyant body in accordance with claim 1 in which the magnitude and distribution of the weight of the body are selected in accordance with the following relation to obtain a body with the desired natural period of roll:

$$Tr=2\pi\sqrt{I/Wh}$$

where

Tr equals the natural period of roll;

I equals the moment of inertia of the body about a horizontal diameter;

W equals the total weight of the body; and h equals the vertical distance between the center of the sphere and the center of gravity of the body.

4. A buoyant body in accordance with claim 2 in which its weight and that of its appurtances and contents is of such magnitude and is so distributed as to make both its natural period of oscillation about a horizontal diameter and its natural period of vertical oscillation greater than ten seconds.

5. A buoyant body in accordance with claim 1 which includes propulsion apparatus making the body self propelled.

6. A buoyant body in accordance with claim 1 including a hull at least the lower half of which is formed principally of concrete.

7. A buoyant body in accordance with claim 1 in which said generally cylindrical surface extends upward high enough to be above the crests of any of said waves and which includes a generally horizontal deck mounted upon the top of said surface.

8. A buoyant body in accordance with claim 7 in which said deck, said generally cylindrical surface and said frusto-conical portion are formed to define a passageway extending from said deck to the interior of said body.

9. A buoyant body in accordance with claim 1 in which said weight is so distributed and of such magnitude that said body tends to float with said first and second portions submerged and with the water line engaging said generally cylindrical surface near its junction with said frustro-conical portion.

10. A buoyant body in accordance with claim 1 in which said structure tangent to said zone at said base extends upward therefrom in a continuous smoothly curved surface.

* * * * *